US007750768B2

(12) United States Patent
Chiesi et al.

(10) Patent No.: US 7,750,768 B2
(45) Date of Patent: Jul. 6, 2010

(54) SWITCHING DEVICE INCLUDING MAGNETIC MICROSWITCHES ORGANIZED IN A MATRIX

(75) Inventors: Laurent Chiesi, Reaumont (FR); Benoît Grappe, Saint Egreve (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 162 days.

(21) Appl. No.: 11/854,588

(22) Filed: Sep. 13, 2007

(65) Prior Publication Data

US 2008/0068115 A1 Mar. 20, 2008

Related U.S. Application Data

(60) Provisional application No. 60/844,667, filed on Sep. 15, 2006.

(30) Foreign Application Priority Data

Oct. 12, 2006 (FR) ..... 06 54230

(51) Int. Cl.
*H01H 51/22* (2006.01)
*H01H 57/00* (2006.01)

(52) U.S. Cl. ..... 335/78; 200/181

(58) Field of Classification Search ..... 335/78–83, 335/170; 200/181; 385/17
See application file for complete search history.

(56) References Cited

U.S. PATENT DOCUMENTS 3,365,701 A * 1/1968 Jones, Jr. ..... 335/152
3,845,430 A * 10/1974 Petkewicz et al. ..... 335/108
6,633,212 B1 * 10/2003 Ruan et al. ..... 335/78
6,750,745 B1 * 6/2004 Wei et al. ..... 335/78
6,778,045 B2 * 8/2004 Orr ..... 335/78
6,794,965 B2 * 9/2004 Shen et al. ..... 335/78
7,253,710 B2 * 8/2007 Shen et al. ..... 335/78
2002/0121951 A1 * 9/2002 Shen et al. ..... 335/78
2002/0196110 A1 * 12/2002 Vaitkus et al. ..... 335/78
2003/0001704 A1 * 1/2003 Shen et al. ..... 335/78
2003/0151480 A1 * 8/2003 Orr ..... 335/78
2003/0222740 A1 * 12/2003 Ruan et al. ..... 335/78
2003/0223676 A1 * 12/2003 Bernstein ..... 385/18
2007/0018760 A1 * 1/2007 Jeong et al. ..... 335/78

FOREIGN PATENT DOCUMENTS

EP 1241697 9/2002
EP 1331656 7/2003

OTHER PUBLICATIONS

U.S. Appl. No. 11/813,591, filed Jul. 10, 2007, Paineau, et al.

* cited by examiner

*Primary Examiner*—Elvin G Enad
*Assistant Examiner*—Alexander Talpalatskiy
(74) *Attorney, Agent, or Firm*—Oblon, Spivak, McClelland, Maier & Neustadt, L.L.P.

(57) ABSTRACT

An electrical switching device including a plurality of magnetic microswitches organized in a matrix on a substrate and each includes a mobile element driven between two stable positions held under the effect of a magnetic field, the device being characterized in that it includes a network of crossed conducting lines, wherein magnetic microswitches are positioned near to intersections formed by the conducting lines. The passage of an electrical current, through two conducting lines commands a change in position of the mobile element of the magnetic microswitch situated at the intersection of the two conducting lines.

10 Claims, 3 Drawing Sheets

SWITCHING DEVICE INCLUDING MAGNETIC MICROSWITCHES ORGANIZED IN A MATRIX

The present invention relates to a switching device composed of a matrix of magnetic microswitches. The invention relates more particularly to a principle for addressing a microswitch within the matrix.

Magnetic microswitches are known from the U.S. Pat. No. 6,469,602 that comprise a beam of ferromagnetic material controlled between an open position and a closed position in order to switch an electrical circuit. The ferromagnetic beam is sensitive to magnetic fields. A first magnetic field generated, for example, by a permanent magnet induces a magnetization along the longitudinal axis of the beam, holding the beam in a first position. Under the effect of a transient magnetic field generated by the passage of a temporary current through a conductor, the beam tilts towards a second position by inversion of the magnetic torque. The beam is then held in this second position under the sole effect of the permanent magnetic field generated by the magnet. In this prior art, the conductor is a planar coil integrated into the substrate.

These microswitches are often organized in a matrix so as to be able to form a switching device in which each microswitch can be controlled separately by means of the planar coil associated with it. However, the multiplication of the number of coils on the substrate of the matrix requires a large surface area of substrate which therefore curtails the possibilities for miniaturization of the device.

The documents EP 1 241 697 and EP 1 331 656 have proposed the individual control of each microswitch of a matrix of microswitches by employing a network of crossed conducting lines. One microswitch is placed at each intersection of a row and a column and can be individually controlled by sending a current through the two conducting lines corresponding to this row and to this column. However, the microswitches employed within the matrix are particularly bulky because they comprise a magnetic circuit having portions passing through the substrate and placed under the substrate. Furthermore, in order to operate, the microswitches each require the use of their own magnet disposed under the substrate for biasing the magnetic circuit.

The aim of the invention is to provide a switching device comprising magnetic microswitches organized in a matrix that are able to be controlled separately without occupying a substantial space on the substrate, under the substrate and through the substrate.

This aim is achieved by an electrical switching device comprising a plurality of magnetic microswitches organized in a matrix on a substrate and each comprising a mobile element driven between two positions and mounted onto one surface of the substrate, the device comprising a network of crossed conducting lines, the magnetic microswitches being positioned near to intersections formed by the conducting lines, the device being characterized in that:

- the mobile element of all the microswitches is designed to be held in a stable manner in each of its two positions under the sole effect of a permanent magnetic field generated in a manner common to all the microswitches,
- the passage of an electrical control current, in a given direction, through two conducting lines commands the change in position of the mobile element of the magnetic microswitch situated at the intersection of the two conducting lines.

According to one feature, the conducting lines are electrical tracks formed in the substrate.

According to another feature, the network is formed from a first series of rectilinear and parallel electrical tracks formed in a first plane and oriented in a first direction and a second series of parallel electrical tracks formed in a second plane parallel to the first plane and oriented in a second direction.

According to another feature, the second direction is for example orthogonal to the first direction.

According to another feature, the mobile element of each microswitch is formed from a ferromagnetic membrane having a longitudinal axis along which the magnetic field induces a magnetic component. The longitudinal axis of the membrane of each microswitch is oriented along the bisector of the angle formed between the two conducting lines that cross each other under the membrane. If the conducting lines are orthogonal to one another, the longitudinal axis of each microswitch will therefore be oriented at 45° with respect to the two conducting lines which cross each other under their membrane.

According to another feature, the membrane of each microswitch has an axis of rotation perpendicular to its longitudinal axis, around which it is designed to pivot between its two positions by inversion of the magnetic torque.

According to another feature, the ferromagnetic membrane has two torsion arms anchored onto the substrate and inscribed into the membrane. This feature contributes towards making the matrix particularly compact since the torsion arms do not protrude outwards.

According to another feature, the device comprises an electronic control device associated with the matrix for controlling the injection of current into the appropriate conducting lines of the network depending on the microswitch to be addressed.

Other features and advantages will become apparent in the detailed description that follows, making reference to one embodiment presented by way of example and represented by the appended drawings in which.

Figure 1:
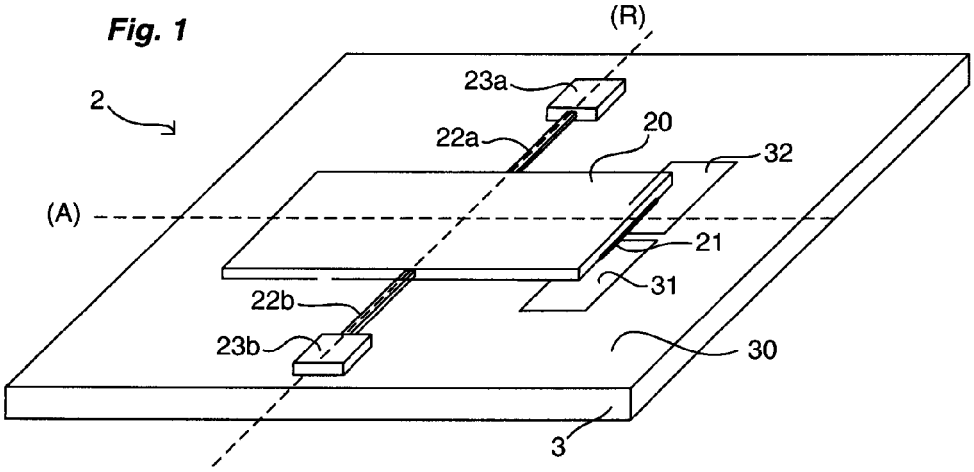
FIG. 1 shows a perspective view of a magnetic microswitch.

A magnetic microswitch 2 such as is shown in FIG. 1 comprises a mobile bistable element mounted on a substrate 3 fabricated in materials such as silicon, glass, ceramics or in the form of printed circuits. The substrate 3 carries on its surface 30 at least two contacts or conducting tracks 31, 32 that are plane, identical and separated, and are designed to be electrically connected by a mobile electrical contact 21 in order to obtain the closing of an electrical circuit (not shown).

The mobile element is composed of a deformable membrane 20 having at least one layer of ferromagnetic material. The membrane has a longitudinal axis (A) and is rigidly fixed to the substrate 3 via two link arms 22*a*, 22*b* connecting the said membrane 20 to two anchoring pads 23*a*, 23*b* disposed symmetrically on either side of its longitudinal axis (A). By torsion of the two link arms 22*a*, 22*b*, the membrane 20 is designed to pivot between an open position and a closed position about a rotation axis (R) parallel to the axis described by the contact points of the membrane 20 with the electrical tracks 31, 32 and perpendicular to its longitudinal axis (A). The mobile electrical contact 21 is disposed under the membrane 20, at the distal end of the latter with respect to its axis (R) of rotation.

When the membrane is in the closed position, the mobile contact 21 electrically connects the two fixed conducting tracks 31, 32 disposed on the substrate, in order to close the electrical circuit. When the membrane is in the open position, the mobile contact 21 is removed from the two conducting tracks so as to open the electrical circuit.

Such a microswitch 2 can be fabricated by a planar duplication technology of the MEMS (for "Micro Electro-Mechanical System") type. The membrane 20 together with the link arms 22*a*, 22*b* are for example formed from the same layer of ferromagnetic material. The ferromagnetic material is for example of the soft magnetic type and may for example be an alloy of iron and nickel ("permalloy"—$Ni_{80}Fe_{20}$).

Figure 10:
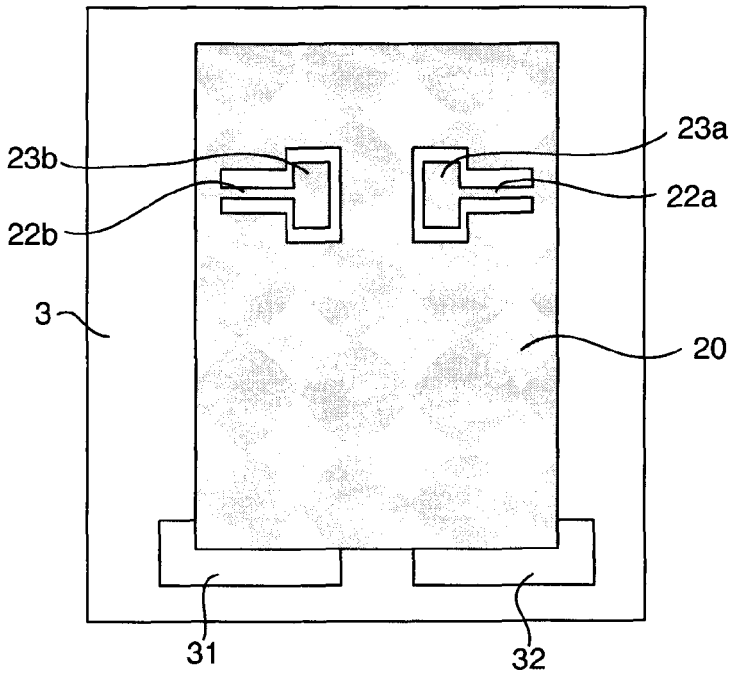
FIG. 10 shows a top view of an advantageous variant embodiment of a magnetic microswitch.

With reference to FIG. 10, in order to gain space on the surface of the substrate, the torsion arms 22*a*, 22*b* together with the anchoring pads 23*a*, 23*b* are inscribed into the perimeter of the membrane 20. The torsion arms 22*a*, 22*b* no longer therefore extend towards the outside of the membrane 20 but towards the inside. They are inscribed into the membrane 20 and are joined to the anchoring pads 23*a*, 23*b* situated directly under the membrane 20.

The integration of the anchoring pads 23*a*, 23*b* and of the torsion arms 22*a*, 22*b* into the perimeter of the membrane 20 offers the advantage of reducing the size of the component and therefore its fabrication cost (by reducing the surface area of substrate required and by increasing the efficiencies).

The magnetic operating mechanism of a microswitch 2 such as is shown in FIG. 1 or 10 consists in subjecting the membrane 20 to a permanent magnetic field $B_0$, preferably uniform and for example oriented perpendicular to the surface of the substrate 3, in order to hold the membrane 20 in each of its positions, and in applying a temporary magnetic control field for controlling the passage of the membrane 20 from one position to the other by inversion of the magnetic torque being exerted on the membrane.

Figure 2:
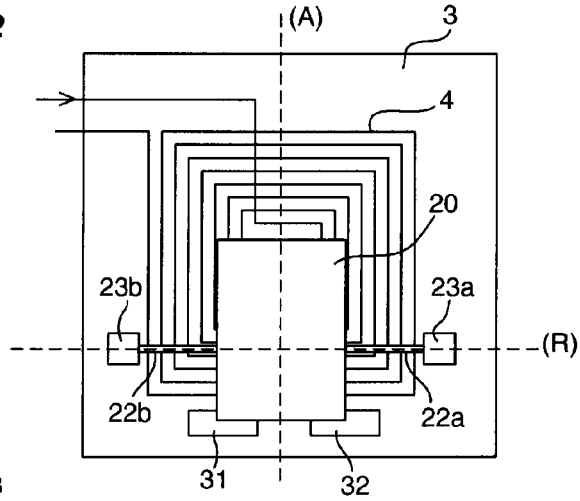
FIG. 2 shows a top view of the magnetic microswitch in FIG. 1, to which a control coil for the microswitch has been added.

In order to generate the permanent magnetic field $B_0$, a permanent magnet (not shown) is used, for example fixed under the substrate 3. In the prior art, the temporary magnetic field is generated by using a planar excitation coil 4 associated with the microswitch 2 (FIG. 2). The passage of a current through the planar excitation coil 4 generates a temporary magnetic field oriented parallel to the substrate 3 and parallel to the longitudinal axis (A) of the membrane 20 for controlling, according to the direction of the current in the coil, the tilting of the membrane 20 from one of its positions towards the other of its positions.

Figure 3:
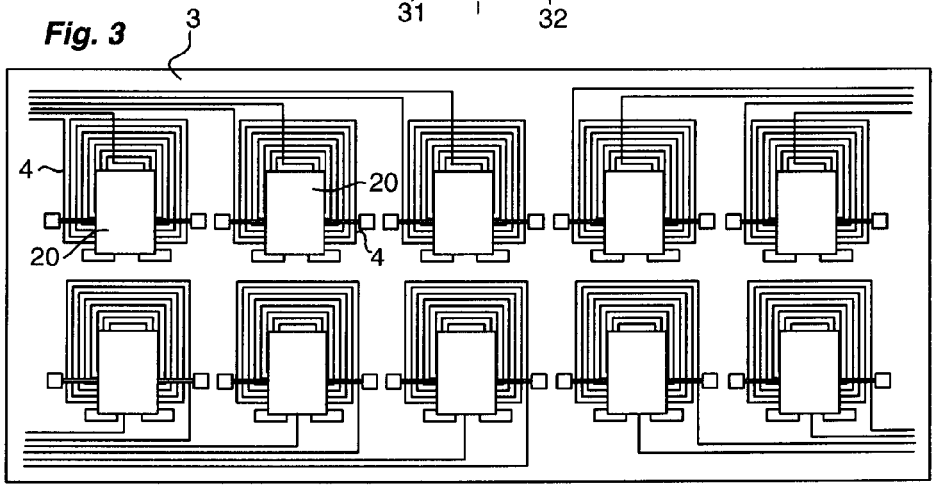
FIG. 3 shows a switching device composed of a matrix of magnetic microswitches of the type shown in FIG. 2.

According to the invention, the use of planar excitation coils for separately controlling several microswitches arranged on a matrix as shown in FIG. 3 considerably increases the surface area of the substrate receiving the microswitches.

Figure 4:
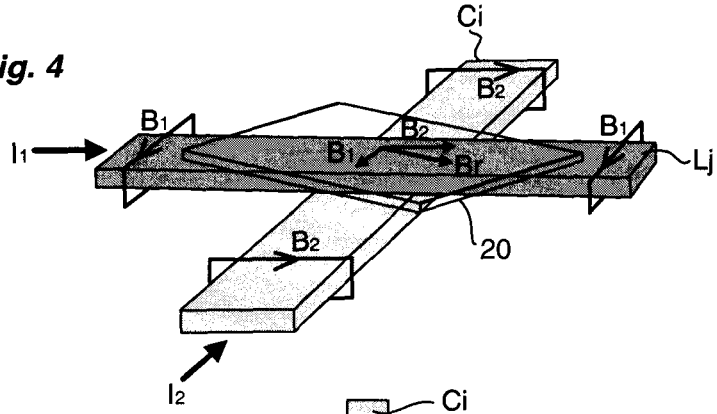
FIGS. 4 and 5 illustrate schematically the principle for addressing a magnetic microswitch according to the invention.

According to the invention, the planar coil 4 associated with a microswitch 2 is therefore replaced by two rectilinear conducting lines disposed one on top of the other and forming an intersection between them (FIG. 4). The two conducting lines are for example electrical tracks Ci, Lj formed in the substrate 3 and for example orthogonal to each other.

Figure 5:
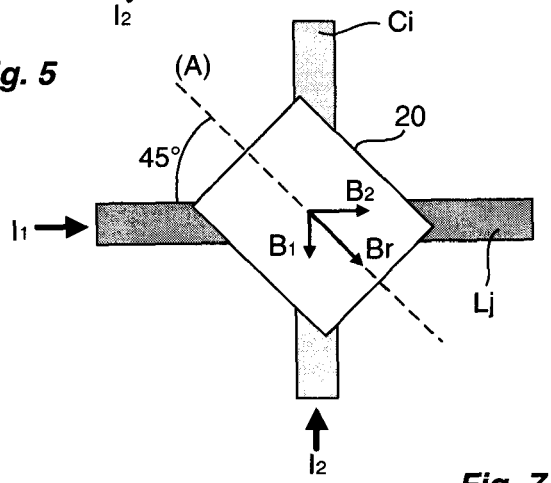

According to the invention, with reference to FIGS. 4 and 5, the membrane 20 of the microswitch is positioned on the substrate 3 at the intersection of the two tracks Ci, Lj. The longitudinal axis (A) of the membrane 20 is oriented along the bisector of the angle formed between the two tracks Ci, Lj. In FIGS. 4 and 5, since the two tracks Ci, Lj are orthogonal to one another, the longitudinal axis (A) of the membrane 20 is therefore oriented at 45° with respect to each of the two tracks Ci, Lj (FIG. 5). In addition, the axis of rotation (R) of the microswitch 2 is situated in a parallel plane above the planes of the electrical tracks.

Figure 6:
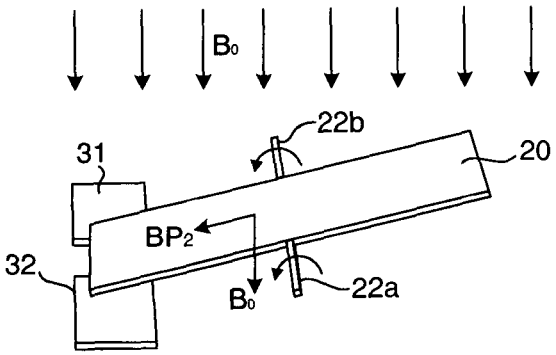
FIGS. 6, 7 and 8 illustrate the principle of operation of a magnetic microswitch.
Figure 7:
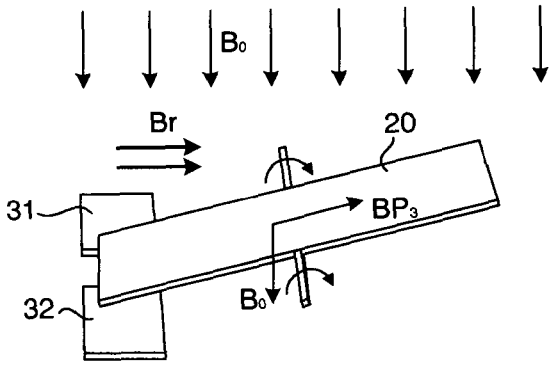

In order to control the membrane 20 of the microswitch 2, a control current $I_1$, $I_2$ is injected, for example of identical amplitude, into each of the two tracks Ci, Lj. The direction of flow of the control current $I_1$, $I_2$ in the tracks determines the direction of rotation of the membrane 20. The control current $I_1$, $I_2$ injected into each track Ci, Lj respectively generates a magnetic field $B_1$ and $B_2$ circulating perpendicularly around the track (FIG. 4). At the intersection of the two tracks Ci, Lj, the superposition of the two magnetic fields $B_1$, $B_2$ generates a resultant magnetic field Br oriented at 45° with respect to the tracks as shown in FIG. 5. This resultant magnetic field Br induces a magnetic component $BP_3$ into the membrane 20 of sufficient intensity to drive the tilting of the membrane 20 towards its other position (FIG. 7). The principle of operation of a magnetic microswitch is detailed hereinbelow:

The substrate 3 supporting the membrane 20 is placed under the effect of the permanent magnetic field $B_0$ already defined hereinabove. As shown in FIG. 6, the first magnetic field $B_0$ initially generates a magnetic component $BP_2$ in the membrane 20 along its longitudinal axis (A). The magnetic torque resulting from the first magnetic field $B_0$ and from the component $BP_2$ generated in the membrane 20 holds the membrane 20 in one of its positions, for example the closed position in FIG. 6.

With reference to FIG. 7, the passage of a control current $I_1$, $I_2$ in a given direction in each of the two electrical tracks Ci, Lj crossing each other under the membrane 20, allows the resultant magnetic field Br defined hereinabove to be generated whose direction is parallel to the substrate 3 and oriented at 45° with respect to the two tracks Ci, Lj, its direction depending on the direction of the current $I_1$, $I_2$ delivered into each of the tracks Ci, Lj. The resultant magnetic field Br generates the magnetic component $BP_3$ in the magnetic layer of the membrane 20. If the control current $I_1$, $I_2$ is delivered into each track Ci, Lj in an appropriate direction, this new magnetic component $BP_3$ will oppose the component $BP_2$ generated in the magnetic layer of the membrane 20 by the first magnetic field $B_0$. If the component $BP_3$ is of higher intensity than that generated by the first magnetic field $B_0$, the magnetic torque resulting from the first magnetic field $B_0$ and from this component $BP_3$ is reversed and causes the membrane 20 to tilt from its closed position towards its open position (FIG. 7).

Figure 8:
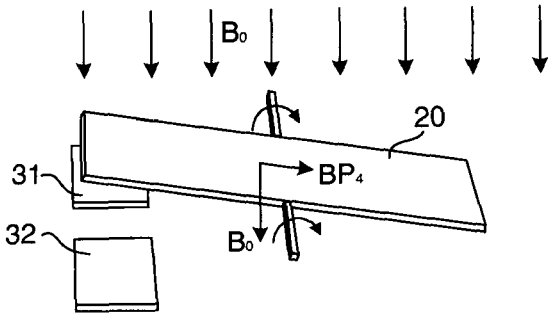

Once the tilting of the membrane 20 has been effected, the supply of current to the two tracks Ci, Lj is no longer required. According to the invention, the resultant magnetic field Br is only generated in a transient manner in order to make the membrane 20 tilt from one position to the other. As shown in FIG. 8, the membrane 20 is then held in its open position under the effect of the first magnetic field $B_0$ alone creating a new magnetic component $BP_4$ within the membrane 20 and a new magnetic torque forcing the membrane 20 to hold itself in its open position (FIG. 6).

According to the invention, the passage of an electrical current $I_1$, $I_2$ through two conducting lines Ci, Lj therefore commands, by inversion of the magnetic torque being applied to the membrane 20, the change of position of the membrane

20 of the magnetic microswitch situated at the intersection of the two conducting lines Ci, Lj.

In a matrix of magnetic microswitches, this operating mechanism and control principle can be employed for addressing each magnetic microswitch individually within the matrix. The permanent magnetic field $B_0$ is for example common to all the microswitches 2 of the matrix.

Figure 9:
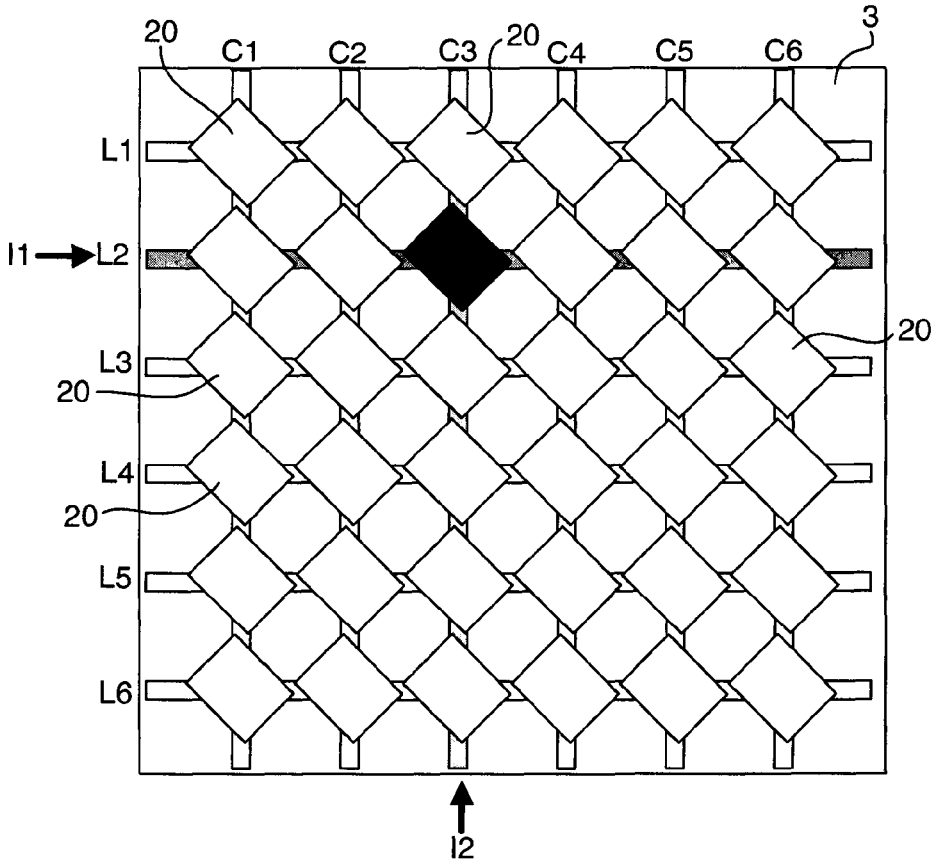
FIG. 9 shows a switching device composed of a matrix of microswitches each addressed according to the principle detailed in FIGS. 4 and 5.

For this purpose, with reference to FIG. 9, a network of electrical tracks, electrically isolated from one another, is constructed under the matrix of microswitches 2. The network is constructed from a first series of rectilinear and parallel electrical tracks (C1, C2, C3, C4, C5, C6) formed within a first plane and oriented in a first direction and a second series of parallel electrical tracks (L1, L2, L3, L4, L5, L6) formed within a second plane parallel to the first plane and oriented in a direction orthogonal to the first direction. The first series of electrical tracks (C1-C6) is for example organized in columns and the second series of electrical tracks (L1-L6) is organized in rows (FIG. 9).

Magnetic microswitches 2, such as are defined hereinabove and shown in FIG. 1 or 10, are positioned near to each intersection of two electrical tracks coming from the first series and from the second series. The membranes 20 of each microswitch 2 are all oriented at 45° as defined hereinabove. The axis of rotation (R) of each microswitch 2 is situated in a parallel plane above the two planes containing the electrical tracks C1-C6, L1-L6 of the network.

In order to address one microswitch 2 within the matrix thus formed, a control current for example of identical amplitude is injected into the two tracks that cross each other under the membrane 20 to be tilted. Depending on the direction of flow of the current through each of the two tracks, the membrane will tilt into one or other of its positions according to the principle described hereinabove. Using such a network therefore allows each microswitch 2 to be easily addressed, being identified for example by its coordinates within the network. These coordinates are the references of the electrical tracks crossing each other under the membrane of the microswitch 2 being controlled. By injecting a control current $I_1$, $I_2$ simultaneously into the tracks C3 and L2 in FIG. 9, the tilting of the membrane 20 of the microswitch 2 situated at the intersection of these two tracks is controlled according to the operating principle described hereinabove in conjunction with FIGS. 4 to 8.

According to the invention, the amplitude of the resultant field Br allows the membrane of the microswitch addressed to be tilted. In contrast, the magnetic fields B1, B2 generated around the tracks by injection of the control current $I_1$, $I_2$ is insufficient to drive the tilting of the membranes of the other microswitches situated in the network.

An electronic control device (not shown) will for example be associated with the matrix for controlling the injection of a control current into the appropriate electrical tracks of the network depending on the microswitch or microswitches 2 to be addressed.

The invention claimed is:

1. An electrical switching device, comprising:

a plurality of magnetic microswitches organized in a matrix on a substrate, each magnetic microswitch including a mobile element driven between two positions and mounted onto one surface of the substrate, the electrical switch device including a network of crossed conducting lines, the magnetic microswitches being positioned near to intersections formed by the conducting lines, wherein the mobile element is configured to be held in a stable manner in each of its two positions under the sole effect of a permanent magnetic field generated for all the microswitches, the mobile element of each microswitch is formed of a ferromagnetic membrane that has two torsion arms anchored onto the substrate and the two torsion arms are completely enclosed within the perimeter of the mobile element, an interior end of a first torsion arm of the two torsion arms connects to a first anchoring pad located at an interior portion of the membrane, an interior end of a second torsion arm of the two torsion arms connects to a second anchoring pad located at an interior portion of the membrane, and exterior ends of the first and second torsion arms connect to exterior portions of the membrane, and the passage of an electrical control current, in a given direction, through two conducting lines, commands the change in position of the mobile element of the magnetic microswitch situated at the intersection of the two conducting lines.

2. The device according to claim 1, wherein the conducting lines are electrical tracks formed in the substrate.

3. The device according to claim 2, wherein the network is formed from a first series of rectilinear and parallel electrical tracks formed in a first plane and oriented in a first direction and a second series of parallel electrical tracks formed in a second plane parallel to the first plane and oriented in a second direction.

4. The device according to claim 3, wherein the second direction is orthogonal to the first direction.

5. The device according to one of claims 1 to 4, wherein the ferromagnetic membrane has a longitudinal axis along which the permanent magnetic field induces a magnetic component.

6. The device according to claim 5, wherein the longitudinal axis of the membrane of each microswitch is oriented along the bisector of the angle formed between the two conducting lines that cross each other under the membrane.

7. The device according to claim 5, wherein the membrane of each microswitch has an axis of rotation perpendicular to its longitudinal axis, around which it is designed to pivot between its two positions by inversion of the magnetic torque.

8. The device according to claim 1, further comprising:

an electronic control device associated with the matrix for controlling the injection of current into the appropriate conducting lines of the network depending on the microswitch to be addressed.

9. The device according to claim 1, wherein the ferromagnetic membrane is made of an alloy of iron and nickel.

10. The device according to claim 1, wherein the ferromagnetic membrane and the two torsion arms are made of a same material.

* * * * *